United States Patent [19]

Cunningham

[11] 4,018,401

[45] Apr. 19, 1977

[54] YARN TUBE WITH SLANT CUT END

[75] Inventor: McCleery B. Cunningham, Hartsville, S.C.

[73] Assignee: Sonoco Products Company, Hartsville, S.C.

[22] Filed: May 28, 1976

[21] Appl. No.: 690,901

[52] U.S. Cl. ..... 242/118.3; 242/18 PW; 242/19; 242/125.1

[51] Int. Cl.[2] ..... B65H 75/10; B65H 75/28

[58] Field of Search ..... 242/125.1, 125.2, 125, 242/18 PW, 18 A, 35.5 R, 118.3, 118.31, 118.32, 118.41, 118, 19

[56] References Cited

UNITED STATES PATENTS

| | | | |
|---|---|---|---|
| 3,488,010 | 1/1970 | Parry | 242/125.1 |
| 3,880,371 | 4/1975 | Landenberger et al. | 242/35.5 R |

*Primary Examiner*—George F. Mautz
*Attorney, Agent, or Firm*—Dennison, Dennison, Meserole & Pollack

[57] ABSTRACT

A tube usable on an automatic yarn tube winding machine of the type requiring a space between tubes on the winding spindle and between the tubes and the spindle shoulder for permitting yarn being wound on the tube to contact knives on the spindle for a severing of the yarn during transfer of the yarn from one tube to another. The tube is provided with a slant cut base end which engages either the base shoulder or the flat cut nose end of an adjoining tube to define a gap for the accommodation of the yarn therebetween.

6 Claims, 3 Drawing Figures

YARN TUBE WITH SLANT CUT END

The present invention generally relates to yarn tubes, and is more specifically concerned with a yarn tube of the type particularly adapted for use on automatic yarn tube winding machines for multiple tubes which require a space between the tubes on the winding spindle and between the innermost tube and the spindle shoulder in order to operate properly and in a manner whereby the yarn, during transfer to the tubes, passes between the tubes and into contact with knives on the spindle for a severing of the yarn.

In providing for the necessary gap or spacing between the tubes, it has heretofore been the practice to provide special spacers, hot melt beads, pins, projections formed by deforming the tube material, etc. Such procedures have given rise to substantial problems in construction and also in use. For example, the hot melt beads and pins become dislodged both in transport and use. Dislodgement in use is in turn an extreme safety hazard due to the high speed at which the tubes rotate.

The present invention proposes a simple although highly unique manner of providing the necessary gap without necessitating any addition of a structural component to the basic tube and without requiring any structural modification of the basic tube subsequent to the formation thereof.

Basically, the necessary gap, as proposed herein, is to be achieved by the unique expedient of cutting the base end of the tube, in the initial formation thereof, on a slant or angle. To so form the base end is diametrically opposed to the conventional teaching in the tube art wherein emphasis is placed on obtaining a flat end or an end cut perpendicular to the axis of the tube.

The angled cut on the base end of the tube is to be such whereby upon a mounting of the tube on a spindle and a positioning of the outermost portion of the base end against the spindle shoulder or perpendicularly cut nose end of an adjacent tube, a gap, tapering in width from the point of abutment to the point diametrically opposed therefrom, will be formed with the gap being of a width, along a substantial portion thereof, so as to allow for passage of the yarn therethrough and into contact with spindle mounted knives for a severing of the yarn. In one preferred form, it is comtemplated that the angle cut will, at its maximum spacing from the plane of the outermost point of the base end, be approximately 3 mm.

Constructed in this manner, it will be appreciated that the necessary tube spacing is provided solely by the expedient of cutting the base end of the tube at an angle during the tube production operation. The resultant product provides a unique structural solution to a requirement in the industry and does it in a manner which is economically feasible and capable of being effected in the regular course of tube manufacture, requiring only a change in the trimming equipment.

The following constitutes the known prior art:

| | |
|---|---|
| 2,298,357 | Elvin et al |
| 2,931,587 | Pistor |
| 3,051,411 | Atwood et al |
| 3,488,010 | Parry |
| 3,814,339 | Hudson |
| German Utility Model No. 7408207 | |

Additional objects and advantages will become apparent from the details of construction and operation as more fully hereinafter described and claimed. Reference is had to the accompanying drawings forming a part hereof, wherein like numerals refer to like parts throughout, and in which:

Figure 1:
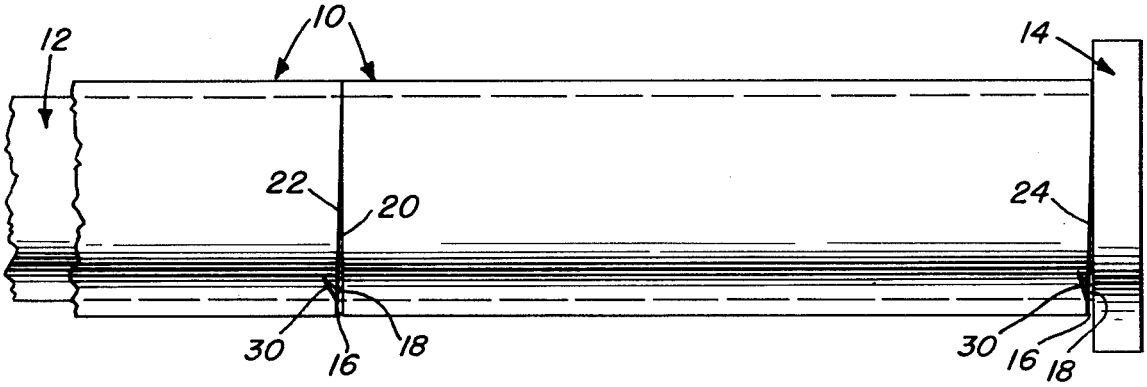
FIG. 1 is a side view of a winding spindle mounting a pair of tubes constructed in accordance with the present invention.

Referring now more specifically to the drawings, reference numeral 10 is used to designate a yarn tube constructed in accordance with the present invention. This tube 10 is particularly adapted for use on the winding spindle 12 of an automatic yarn tube winding machine of the type which provides for multiple tubes on the spindle with a space being required between the tubes as well as between the innermost tube and the spindle shoulder 14.

The required space, generally designated by reference numeral 16, allows yarn being wound on the tubes 10 to contact knives 18 provided on the spindle 12 itself so as to effect a cutting of the yarn during transfer of the yarn to the tubes and upon initiation of the winding on the tubes.

Figure 2:
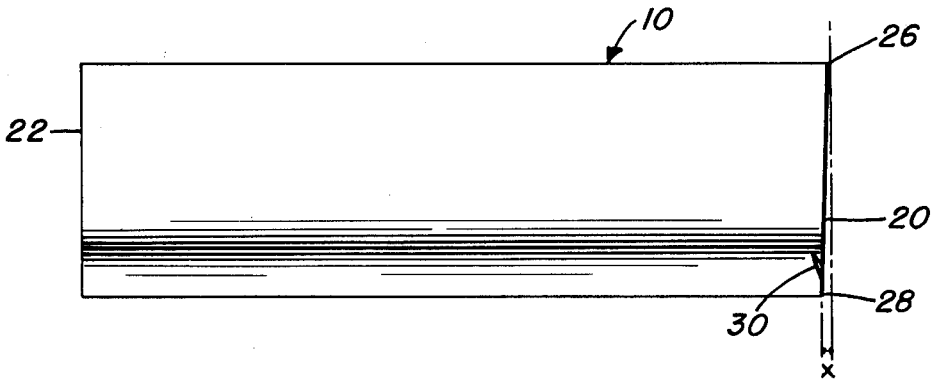
FIG. 2 illustrates one of the tubes of FIG. 1.
Figure 3:
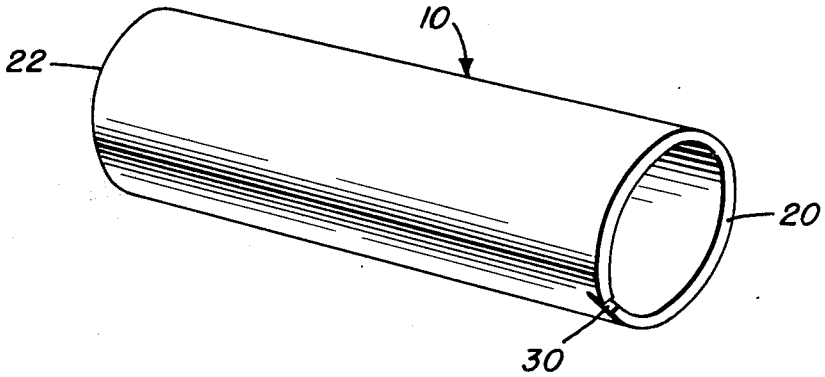
FIG. 3 is a perspective view of a tube constructed in accordance with the invention herein.

The present invention proposes the provision of the spaces 16 by a unique modification of the base end 20 of the tube 10. This modification involves the cutting of the base end 20 on a slant or angle, other than perpendicular, to the linear axis of the tube whereby, upon engagement of this slant cut base end 20 with the perpendicular nose end 22 of an adjoining tube, or the perpendicular face 24 of the spindle shoulder, the desired space 16 will be defined. Noting FIG. 2 in particular, it is to be appreciated that the distance $x$, between the parallel planes of the outermost and innermost base end points, 26 and 28 respectively, is to be such so as to provide for a spacing 16 of sufficient circumferential extent about the tubes 10 so as to easily accommodate the yarn therein. A distance $x$ of approximately 3 mm has been found to be acceptable.

By providing for the required space 16 in this manner, it will be appreciated that the actual manufacture of the tube differs from conventional tube manufacture only by a slant cutting of the base end 20 of the tube 10 as opposed to the present manner of production wherein it is considered essential to cut the base end perpendicular to the axis of the tube. The resultant structure is unique and provides significant advantages in economically and effectively achieving a result heretofore only available by additional manufacturing procedures effected subsequent to the initial construction of the tube. The improvements proposed herein also introduce a significant safety factor in the final product.

It is of course to be recognized that the basic tube construction, other than for the slant or angle cutting of the base end, remains the same. As such, appropriate means, such as notch 30, is provided for picking up the incoming yarn and pulling the yarn into the adjoining gap to effect a cutting thereof, the notch 30 also initiating the winding of the yarn on the tubes.

The foregoing is considered illustrative of the primary embodiment of the invention. However, it is to be appreciated that various modifications may occur to those skilled in the art. For example, while the nose end 22 has been defined as perpendicular to the axis of the tube 10 it can readily be appreciated that this end can also be angularly orientated with the only requirement being that the angular orientations of the opposed ends so relate to each other as to insure the provision of the required space 16 upon the abutment of adjacent ends of adjoining tubes. In view of the above, it is intended that all suitable modifications and equivalents may be resorted to within the scope of the invention as claimed.

What is claimed as new is:

1. A yarn tube for use on a winding spindle having cutting means thereon, said yarn tube including a linear axis and first and second ends, said ends being planar and oriented at different angles to the linear axis of the tube, the plane of one of said ends forming an acute angle with a plane perpendicular to the linear axis whereby, upon the abutment of the first end of the tube with the second end of a duplicate tube in axial alignment therewith, an abutting surface and a space will be provided between the abutted tube ends with the space extending about a significant portion of the circumference of the tubes in the area of the abutment for passage of yarn therethrough and into engagement with spindle mounted cutting means.

2. The yarn tube of claim 1 including means on said tube for picking up incoming yarn and pulling the incoming yarn into said space and into engagement with the spindle mounted cutting means.

3. The yarn tube of claim 1 wherein the plane of the other of said planar ends is oriented perpendicular to the linear axis.

4. The yarn tube of claim 1 wherein planes perpendicular to the linear axis of the tube and extending through the extreme points of said one of said ends are spaced approximately three millimeters.

5. For use in an automatic yarn tube winding machine requiring a space between multiple tubes, and/or between a tube and the spindle shoulder, on a winding spindle having yarn cutting means thereon, a yarn tube mountable on said spindle, said yarn tube including opposed planar ends oriented at different angles to the longitudinal axis of said tube, the plane of at least one of said planar ends forming an acute angle with a plane perpendicular to the longitudinal axis of said tube whereby, upon abutment of said one end against the opposite end of a duplicate tube, or against a spindle shoulder, an abutting surface and a yarn passing space will be provided therebetween with the space extending about a significant portion of the circumference of the tube for passage of the yarn therethrough.

6. The yarn tube of claim 5 including means on said tube for picking up incoming yarn and pulling the incoming yarn into said space and into engagement with the spindle mounted cutting means.

* * * * *